US009021639B1

(12) United States Patent
Lin

(10) Patent No.: US 9,021,639 B1
(45) Date of Patent: May 5, 2015

(54) MATTRESS STRUCTURE

(71) Applicant: Yao I Fabric Co., Ltd., Chang-Hwa County (TW)

(72) Inventor: Mei-Chun Lin, Chang-Hwa County (TW)

(73) Assignee: Yao I Fabric Co., Ltd., Changhua County (TW)

( * ) Notice: Subject to any disclaimer, the term of this patent is extended or adjusted under 35 U.S.C. 154(b) by 0 days.

(21) Appl. No.: 14/597,435

(22) Filed: Jan. 15, 2015

(30) Foreign Application Priority Data

Sep. 10, 2014 (TW) ..... 103216026

(51) Int. Cl.
*A47C 27/00* (2006.01)
*A47C 27/14* (2006.01)
*A47C 31/00* (2006.01)

(52) U.S. Cl.
CPC ..... *A47C 27/14* (2013.01); *A47C 31/00* (2013.01)

(58) Field of Classification Search
CPC ..... A47C 27/00
USPC ..... 5/739–740, 727, 655.9
See application file for complete search history.

(56) References Cited

U.S. PATENT DOCUMENTS 5,639,543 A * 6/1997 Isoda et al. ..... 428/220
6,347,790 B1 * 2/2002 Nishibori et al. ..... 267/148
7,625,629 B2 * 12/2009 Takaoka ..... 428/220

* cited by examiner

*Primary Examiner* — Fredrick Conley
(74) *Attorney, Agent, or Firm* — Rosenberg, Klein & Lee

(57) ABSTRACT

A mattress structure contains: an elastic mattress. The elastic mattress includes a main body, two elongated extensions extending along two peripheral sides of the main body, and an outer segment formed on one end thereof to correspond to user's feet. The elastic mattress is made of plural first plastic wires which are solid and are irregularly winded together, a connection portion of at least two of the plural first plastic wires is melted, and a disconnection portion of the at least two of the plural first plastic wires includes plural gaps formed therein. The elastic mattress also includes two support areas arranged below the two elongated extensions, and each support areas has plural second plastic wires winded therein, wherein a density of the plural second plastic wires is greater than those of the other positions of the elastic mattress besides the two support areas.

8 Claims, 8 Drawing Sheets

MATTRESS STRUCTURE

FIELD OF THE INVENTION

The present invention relates to a mattress structure which contains an elastic mattress and two elongated extensions of various elasticity so that a user gets up off a bed safety.

BACKGROUND OF THE INVENTION

A conventional spring mattress contains an elastic body and a filler, wherein the elastic body includes plural springs, a plurality of connecting wires, and plural fixing wires, wherein the plurality of connecting wires are applied to connect the plural springs to support a pressure as a user's turns his/her body, and the plural fixing wires are served to protect the plural springs. In addition, the filler is filled into a buffer layer between the user and the plural springs and is made of cloth and cotton or foam to obtain air permeation.

However, when the user gets up of off a bed, it is easy to fall off from the bed, because the conventional spring mattress has fixed elasticity.

The present invention has arisen to mitigate and/or obviate the afore-described disadvantages.

SUMMARY OF THE INVENTION

The primary objective of the present invention is to provide a mattress structure which contains an elastic mattress and two elongated extensions of various elasticity so that a user gets up off a bed safety.

To obtain the above objective, a mattress structure contains: an elastic mattress. The elastic mattress includes a main body with a predetermined thickness, two elongated extensions extending along two peripheral sides of the main body, and an outer segment formed on one end thereof to correspond to user's feet, the elastic mattress being made of plural first plastic wires which are solid and are irregularly winded together, wherein a connection portion of at least two of the plural first plastic wires is melted, and a disconnection portion of the at least two of the plural first plastic wires includes plural gaps of various sizes formed therein.

The elastic mattress also includes two support areas arranged below the two elongated extensions, and each of the two support areas having plural second plastic wires winded therein, wherein a density of the plural second plastic wires is greater than those of the other positions of the elastic mattress besides the two support areas, and plural voids are formed in each support areas, wherein a size of each void is less than that of each gap, such that an elasticity of each support area is less than that of the main body.

Thereby, when the user turns his/her body and gets up, his/her body presses one of the two elongated extensions, and the one of the two elongated extensions is supported by the at least one support area to avoid great a deformation, thus getting up off the bed safely.

Preferably, the elastic mattress includes the plural gaps, air flows through the plural gaps of the elastic mattress to cause air circulation in the mattress structure.

DETAILED DESCRIPTION OF THE PREFERRED EMBODIMENTS

Figure 1:
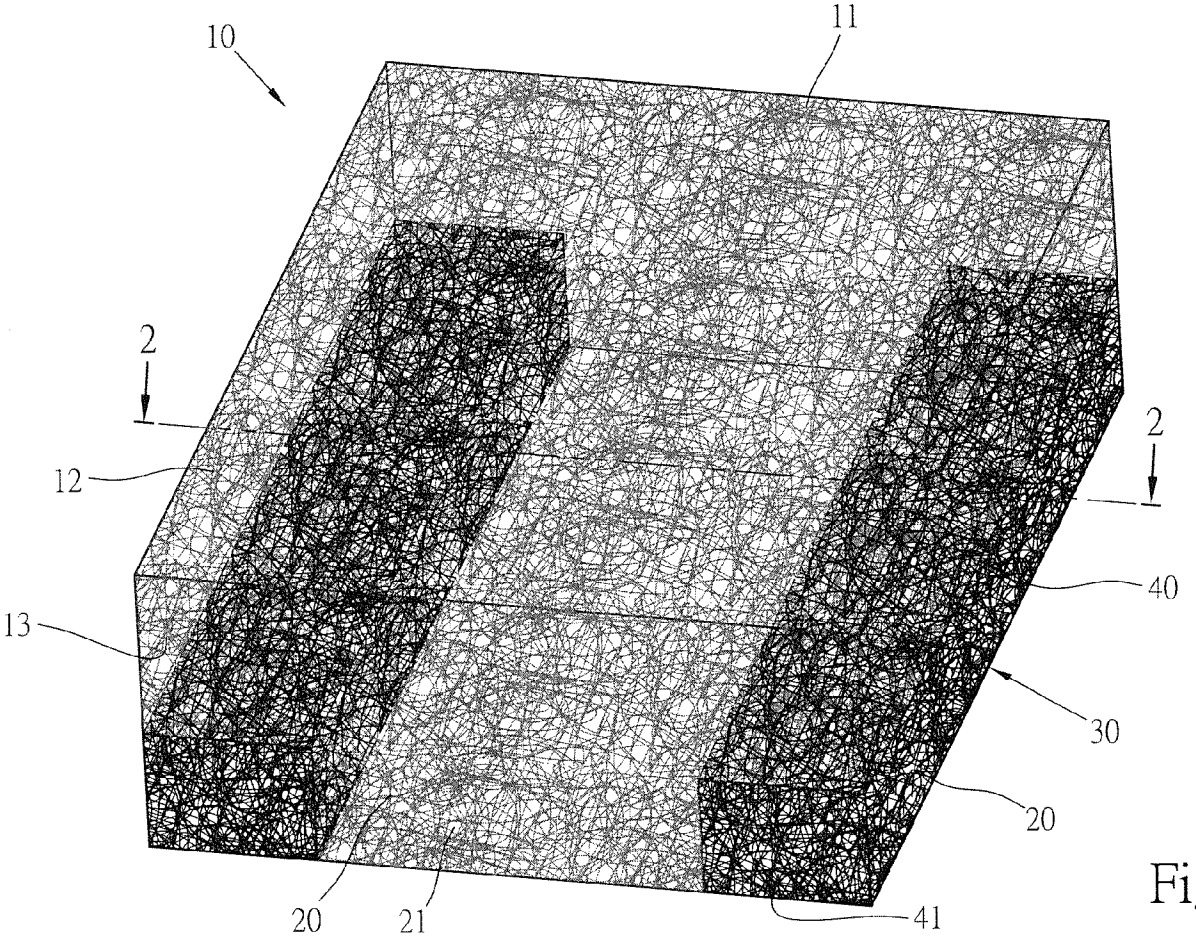
FIG. 1 is a perspective view showing the assembly of a mattress structure according to a first embodiment of the present invention.
Figure 2:
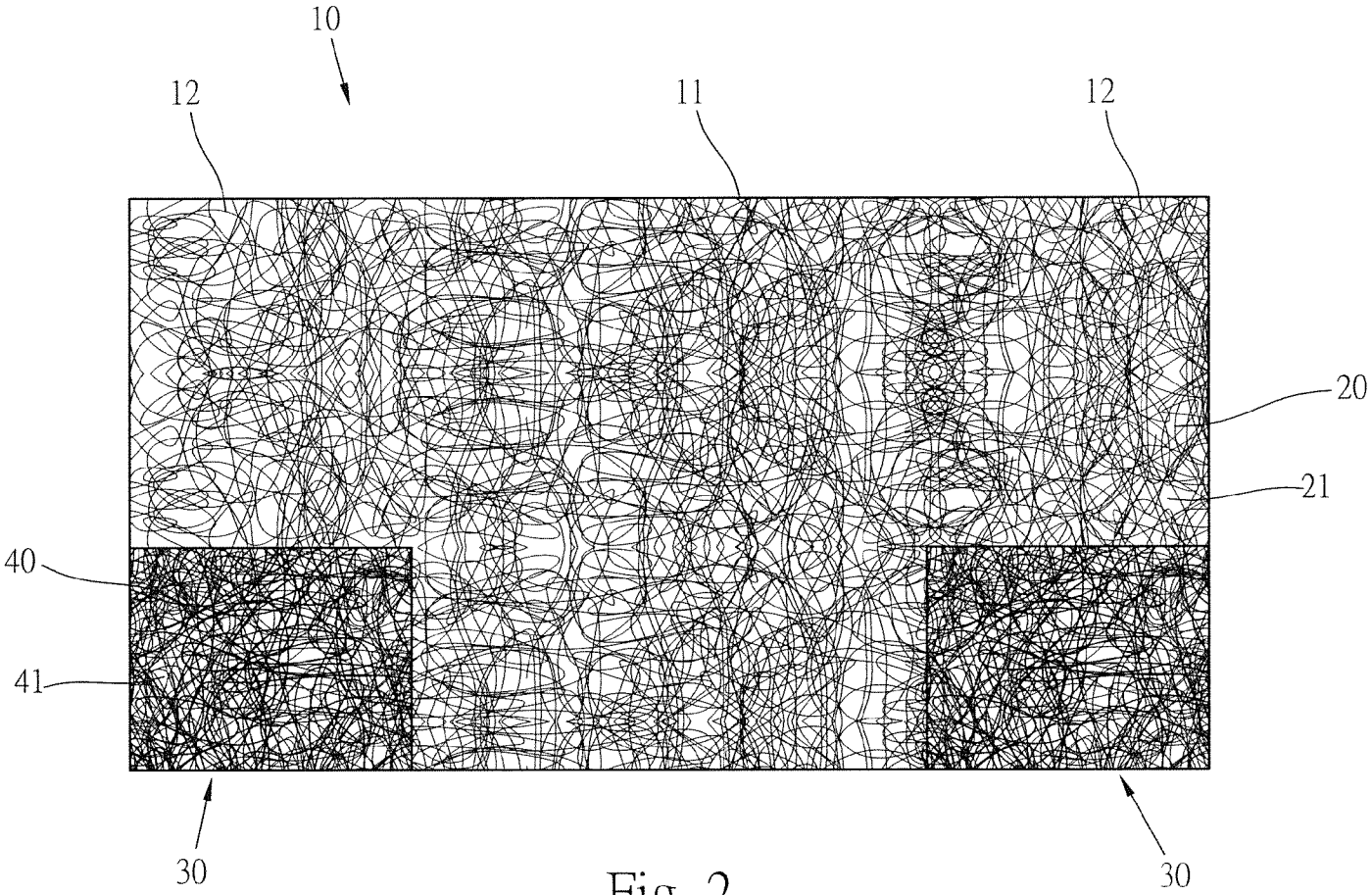
FIG. 2 is a cross sectional view taken along the line 2-2 of FIG. 1.

With reference to FIGS. 1 and 2, a mattress structure according to a first embodiment of the present invention comprises: an elastic mattress 10, and the elastic mattress 10 includes a main body 11 with a predetermined thickness, two elongated extensions 12 extending along two peripheral sides of the main body 11, and an outer segment 13 formed on one end thereof to correspond to user's feet, wherein the elastic mattress 10 also includes at least one support area 30 arranged on a lower end thereof relative to the main body 11, and an elasticity of the at least one support area 30 is less than those of the other portions of the elastic mattress 10 besides the main body 11 to provide proper rigidity.

The elastic mattress 10 made of plural first plastic wires 20 which are solid and are irregularly winded together, wherein a connection portion of at least two of the plural first plastic wires 20 is melted, and a disconnection portion of the at least two of the plural first plastic wires 20 includes plural gaps 21 of various sizes formed therein. In production, plastic materials are fed into a plastic molding machine and are pressed and molded to produce the plural first plastic wires 20 with a predetermined diameter, and then the plural first plastic wires 20 are winded together and are guided into a mold to be further heated, such that the connection portion of the at least two of the plural first plastic wires 20 is melted, thereafter the plural first plastic wires 20 are delivered out of the mold to be cooled, cut, and trimmed, thus producing the elastic mattress 10. Due to the elastic mattress 10 includes the plural gaps 21, air flows through the plural gaps 21 of the elastic mattress 10 to cause air circulation in the mattress structure.

It is to be noted that a density of plural second plastic wires 40 in each of the at least one support area 30 is greater than those of the other positions of the elastic mattress 10 besides the at least one support area 30, and plural voids 41 are formed in the at least one support area 30, wherein a size of each void 41 is less than that of each gap 21, such that the elasticity of the at least one support area 30 is less than that of the main body 11, thus causing a larger rigidity of the main body 11. Furthermore, the two elongated extensions 12 are supported by the at least one support area 30 so that an elasticity of the two elongated extensions 12 is decreased. Accordingly, when the user turns his/her body and gets up, his/her body presses one of the two elongated extensions 12, and the one of the two elongated extensions 12 is supported by the at least one support area 30 to avoid great a deformation, thus getting up off the bed safely.

Figure 3:
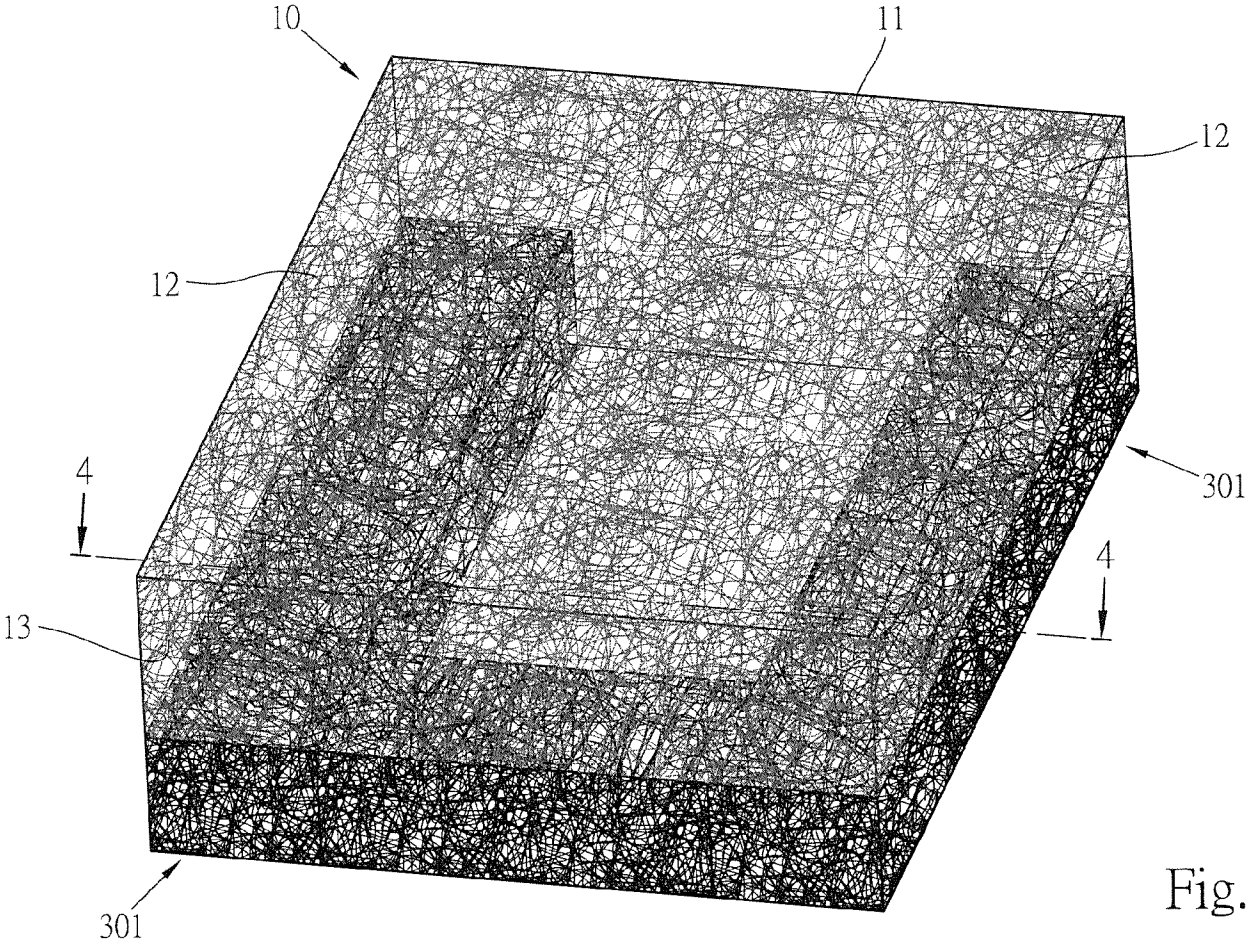
FIG. 3 is a perspective view showing the assembly of a mattress structure according to a second embodiment of the present invention.
Figure 4:
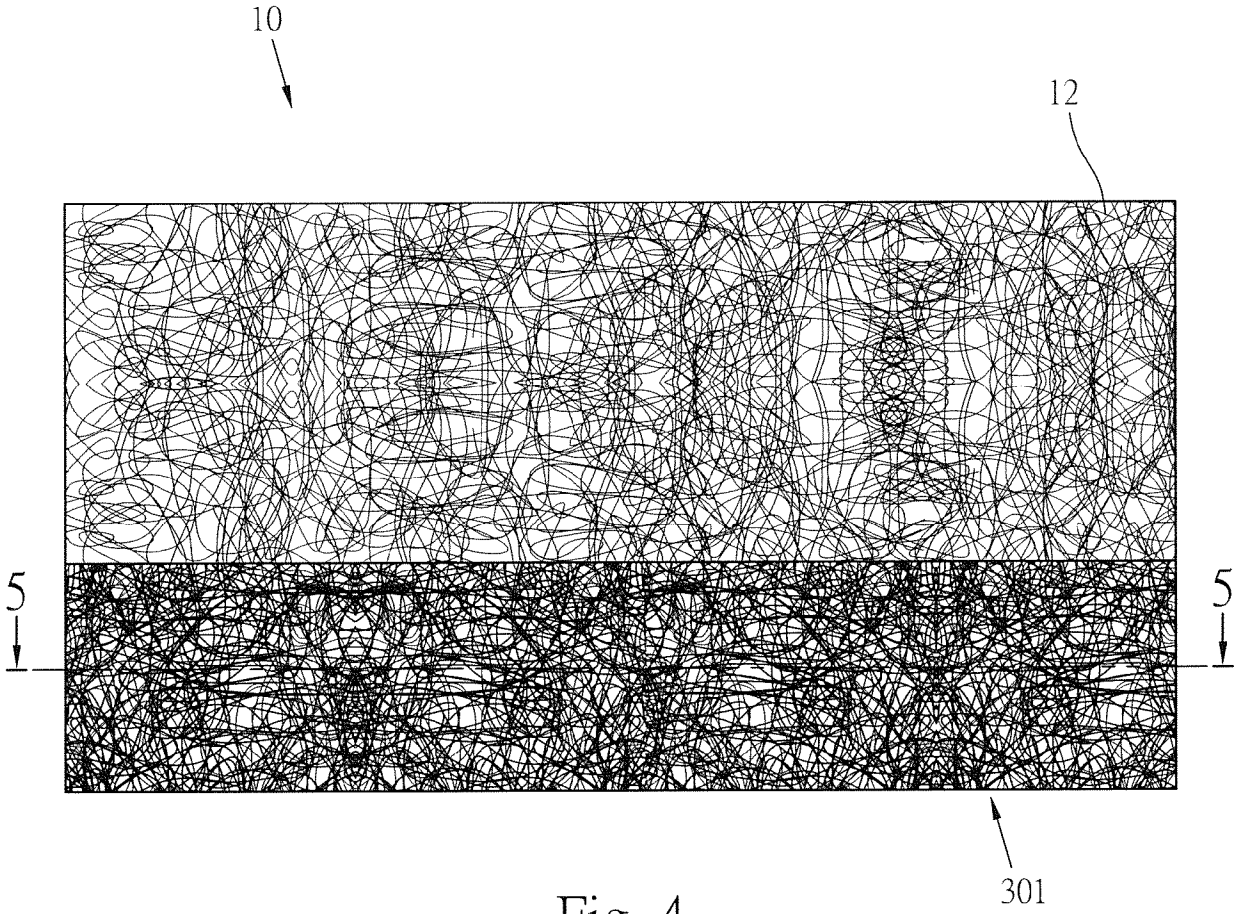
FIG. 4 is a cross sectional view taken along the line 4-4 of FIG. 3.
Figure 5:
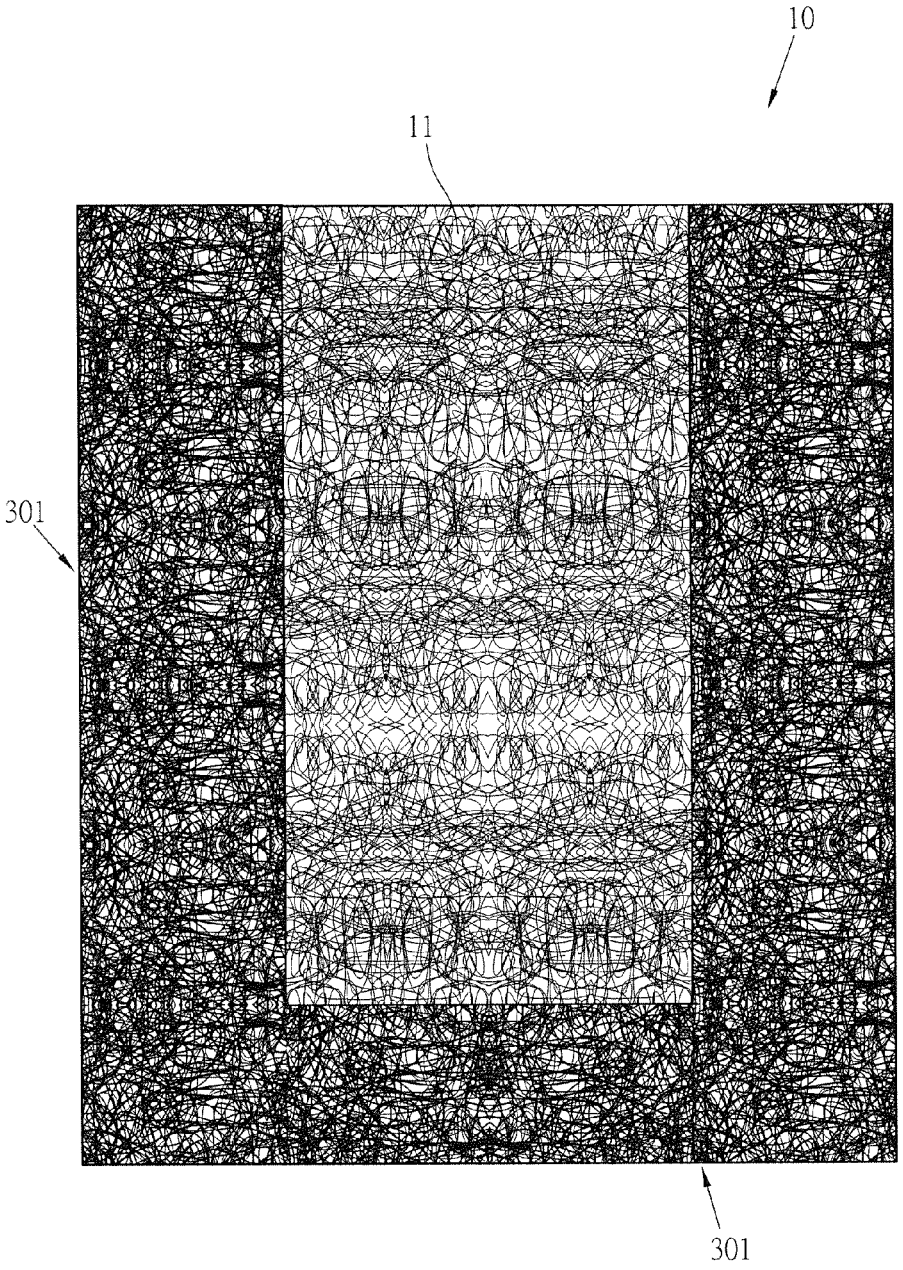
FIG. 5 is a cross sectional view taken along the line 5-5 of FIG. 4.

Referring to FIGS. 1 and 2, in the first embodiment, two elongated support areas 30 are arranged below the two elongated extensions 12 and are configured to correspond to the two elongated extensions 12. As shown in FIGS. 3 to 5, in a second embodiment, two elongated support areas 30 are arranged below the two elongated extensions 12 which extend along the two peripheral sides of the main body 11, and another support areas 30 is arranged below the outer segment 13 which is formed on one end of the elastic mattress 10 and is located between the two support areas 30, thus forming a U-shaped support for supporting the two elongated extensions 12 and the outer segment 13.

Figure 6:
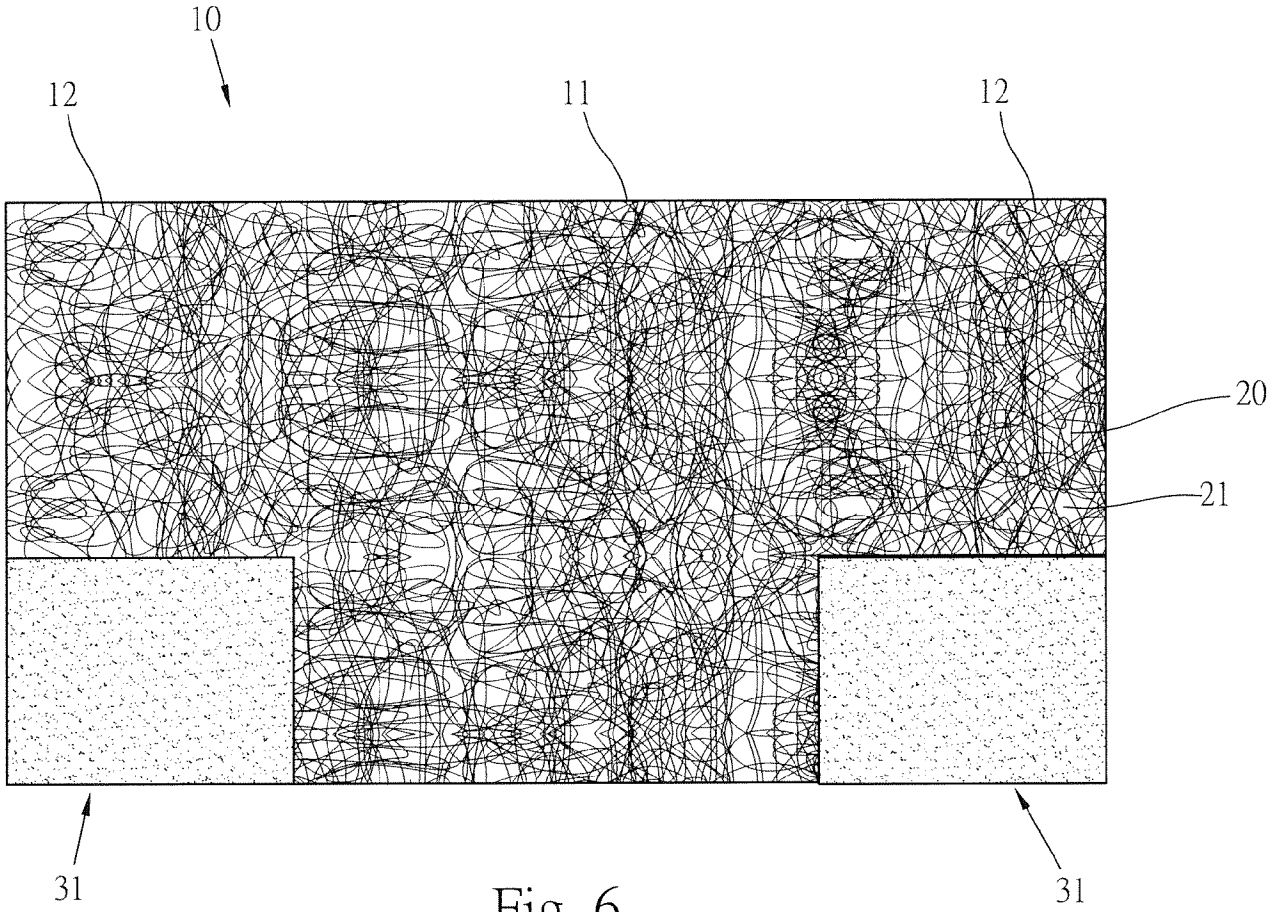
FIG. 6 is a cross sectional view showing the assembly of a mattress structure according to a third embodiment of the present invention.

With reference to FIG. 6, in a third embodiment, two vertically flexible cotton protrusions 31 are arranged below the two elongated extensions 12 which extend along the two peripheral sides of the main body 11 to replace the two support areas 30 of the first embodiment. Preferably, each support area 30 is made of high-density foams.

Figure 7:
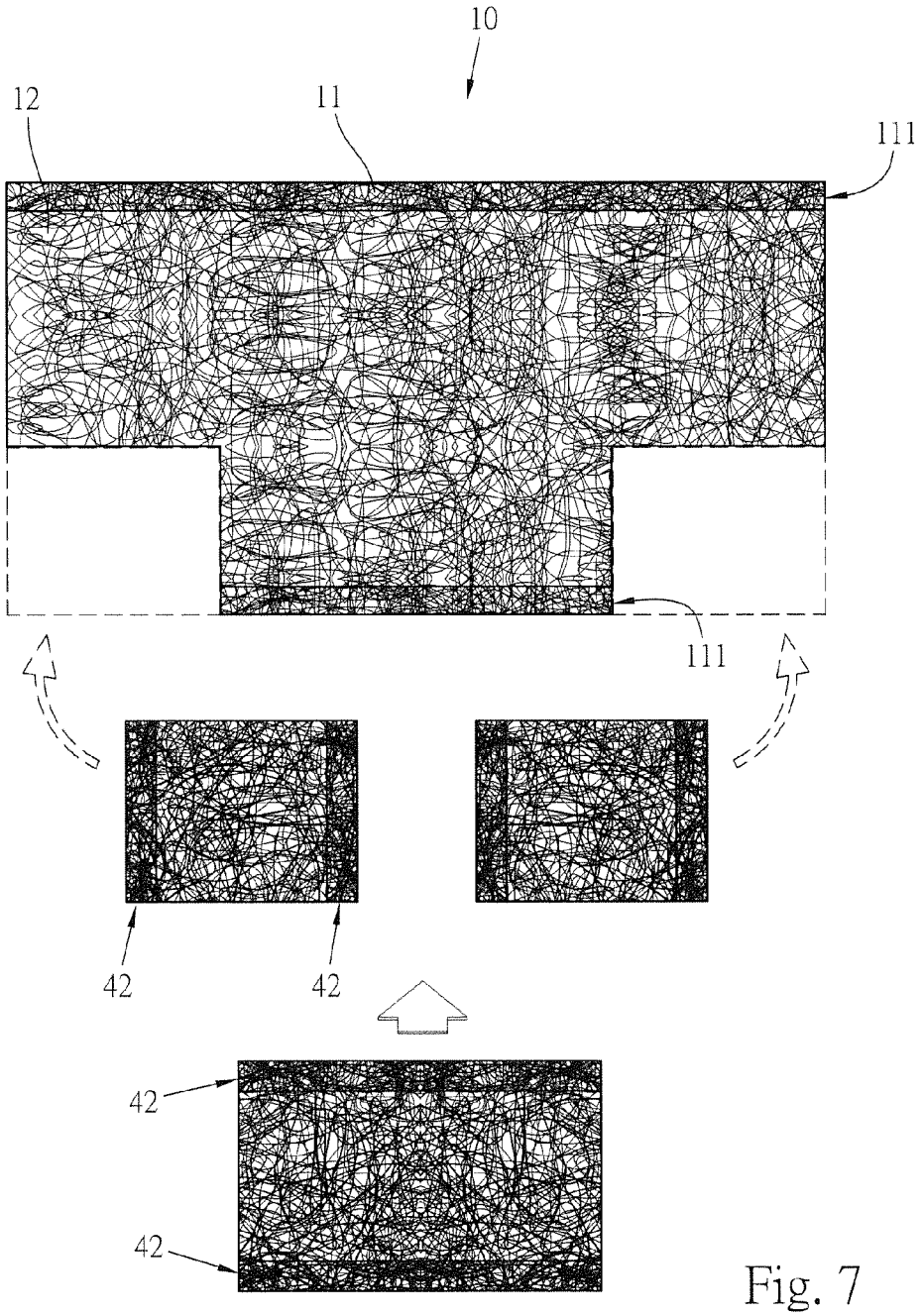
FIG. 7 is a cross sectional view showing the exploded components of a mattress structure according to a fourth embodiment of the present invention.
Figure 8:
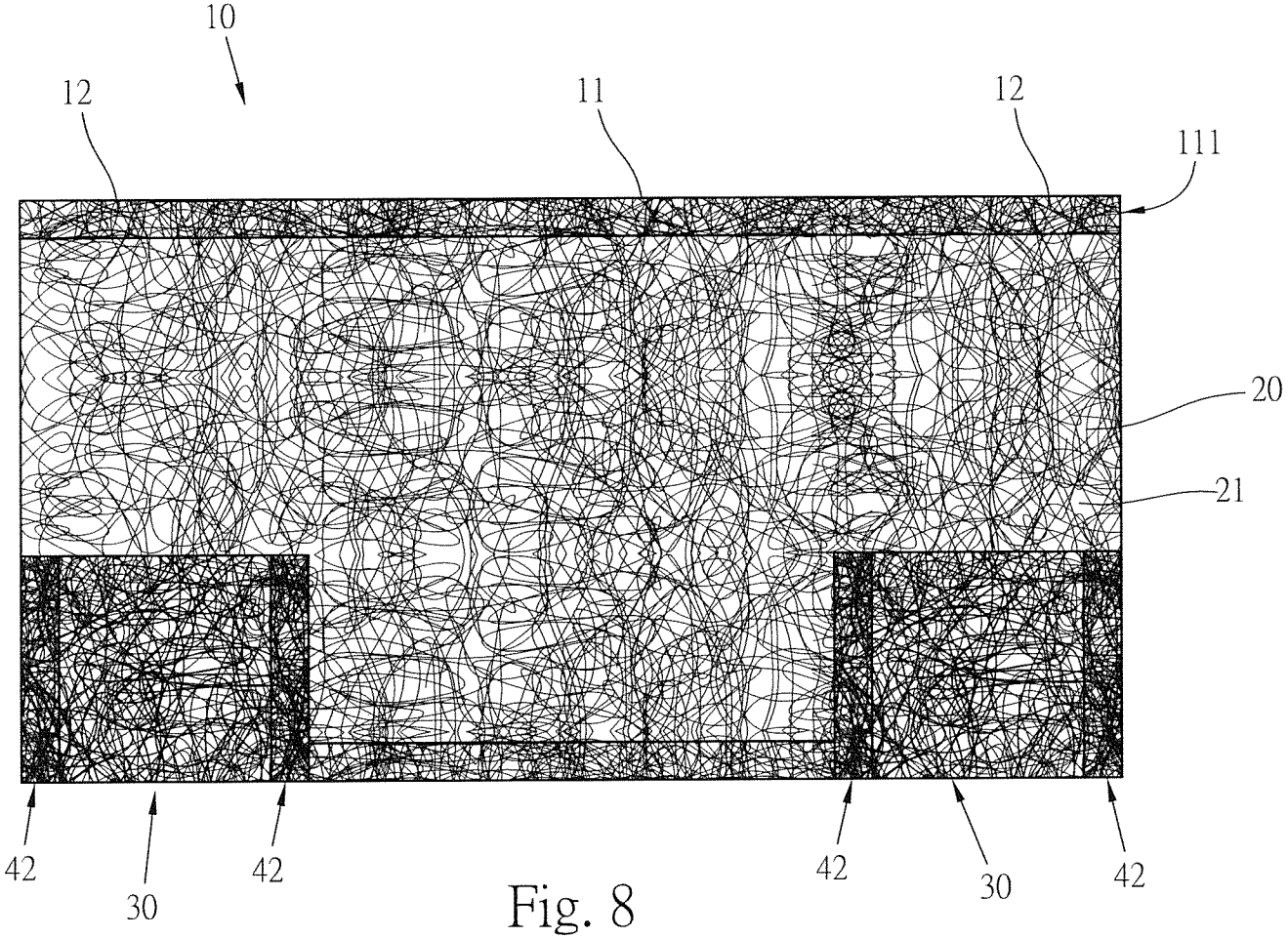
FIG. 8 is a cross sectional view showing the assembly of a mattress structure according to the fourth embodiment of the present invention.

Referring to FIGS. 7 and 8, in a fourth embodiment, the plural first plastic wires 20 have two first surface layers 111 formed on a top surface and a bottom surface thereof, wherein a density of the two first surface layers 111 is 10 to 30% higher than that of the plural first plastic wires 20, and the plural second plastic wires 40 have two second surface layers 42 formed on two sides thereof, wherein a density of the two second surface layers 42 is 10 to 30% higher than that of the plural second plastic wires 40, such that the two first surface layers 111 are also formed on a top surface and a bottom surface of the two elongated extensions 12, and the plural second plastic wires 40 are cut to form the two support areas 30. After rotating 90 degrees, the density of the two second surface layers 42 is 10 to 30% higher than that of the two support areas 30 to enhance support strength of the mattress structure.

Preferably, the plural first plastic wires 20 and the plural second plastic wires 40 can be hollow as well.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A mattress structure comprising:

an elastic mattress, and the elastic mattress including a main body with a predetermined thickness, two elongated extensions extending along two peripheral sides of the main body, and an outer segment formed on one end thereof to correspond to user's feet, the elastic mattress being made of plural first plastic wires which are solid and are irregularly winded together, wherein a connection portion of at least two of the plural first plastic wires is melted, and a disconnection portion of the at least two of the plural first plastic wires includes plural gaps of various sizes formed therein; and the elastic mattress also including two support areas arranged below the two elongated extensions, and each of the two support areas having plural second plastic wires winded therein, wherein a density of the plural second plastic wires is greater than those of the other positions of the elastic mattress besides the two support areas, and plural voids are formed in each support areas, wherein a size of each void is less than that of each gap, such that an elasticity of each support area is less than that of the main body.

2. The mattress structure as claimed in claim 1, wherein two support areas are elongated to correspond to the two elongated extensions which extend along two peripheral sides of the main body.

3. The mattress structure as claimed in claim 1, wherein two elongated support areas are arranged below the two elongated extensions which extend along the two peripheral sides of the main body, and another support areas is arranged below the outer segment which is formed on one end of the elastic mattress and is located between the two support areas, thus forming a U-shaped support.

4. The mattress structure as claimed in claim 1, wherein two vertically flexible cotton protrusions are arranged below the two elongated extensions which extend along the two peripheral sides of the main body.

5. The mattress structure as claimed in claim 1, wherein each support area is made of high-density foams.

6. The mattress structure as claimed in claim 1, wherein the plural first plastic wires have two first surface layers formed on a top surface and a bottom surface thereof, wherein a density of the two first surface layers is 10 to 30% higher than that of the plural first plastic wires.

7. The mattress structure as claimed in claim 1, wherein the plural second plastic wires have two second surface layers formed on two sides thereof, wherein a density of the two second surface layers is 10 to 30% higher than that of the plural second plastic wires.

8. The mattress structure as claimed in claim 1, wherein the plural first plastic wires and the plural second plastic wires are hollow.

* * * * *